US006993115B2

(12) United States Patent
McGuire et al.

(10) Patent No.: US 6,993,115 B2
(45) Date of Patent: Jan. 31, 2006

(54) FORWARD X-RAY GENERATION

(76) Inventors: Edward L. McGuire, 2060 Rialto Way, Mountain View, CA (US) 94043; Mario A. Lecce, 709 Ventura St., Richmond, CA (US) 94805

( * ) Notice: Subject to any disclaimer, the term of this patent is extended or adjusted under 35 U.S.C. 154(b) by 0 days.

(21) Appl. No.: 10/748,961

(22) Filed: Dec. 30, 2003

(65) Prior Publication Data

US 2004/0151280 A1 Aug. 5, 2004

Related U.S. Application Data

(60) Provisional application No. 60/437,378, filed on Dec. 31, 2002.

(51) Int. Cl.
*H01J 35/08* (2006.01)

(52) U.S. Cl. ..... 378/124; 378/143

(58) Field of Classification Search ..... 378/121, 378/124, 137, 143, 142, 119
See application file for complete search history.

(56) References Cited

U.S. PATENT DOCUMENTS

| | | | | |
|---|---|---|---|---|
| 4,675,890 | A * | 6/1987 | Plessis et al. | 378/121 |
| 6,141,400 | A * | 10/2000 | Schardt et al. | 378/124 |
| 6,487,272 | B1 * | 11/2002 | Kutsuzawa | 378/140 |
| 6,553,096 | B1 * | 4/2003 | Zhou et al. | 378/122 |
| 6,749,337 | B1 * | 6/2004 | Artig et al. | 378/203 |

* cited by examiner

*Primary Examiner*—David V. Bruce
*Assistant Examiner*—Hoon Song
(74) *Attorney, Agent, or Firm*—Leyendecker & Lemire, LLC; Kurt Leyendecker

(57) ABSTRACT

X-ray generator devices and methods for operating the same that utilizes anodes comprising thin cylinders to generate characteristic X-ray spectra, which emerges from the cylinders axially, as an intense beam.

16 Claims, 9 Drawing Sheets

FORWARD X-RAY GENERATION

REFERENCE TO RELATED APPLICATIONS

This application claims priority to the provisional application No. 60/437,378 filed on Dec. 31, 2002 entitled "Forward X-ray Generation", and having the same inventors as this application.

FIELD OF THE INVENTION

The present invention relates generally to the generation of X-rays and more particularly to a method and device for producing a directed and focused beam of X-rays.

BACKGROUND

X-rays are generated whenever a high-energy electron beam (usually 70 to 150 Kilovolts) strikes a metallic anode, such as Tungsten or Molybdenum. However, existing X-ray generators emit X-rays in a direction different from the direction of the electron beam.

In a conventional X-ray generator, the electron beam typically falls upon the surface of a planar anode at an angle of incidence between 90 and 45 degrees. The process by which X-rays are produced tends to create radiation diverging from the anode over a considerable solid angle that is far greater than can be utilized for any given application.

This excessive solid angle of X-ray emission creates a radiation hazard requiring large amounts of heavy and expensive shielding material. Since the X-rays are scattered, the power requirements of the X-ray apparatus are relatively large to insure the proper "brightness" or intensity of the section of the diverging beam that is being utilized. The efficiency of conventional X-ray apparatus is relatively small since a significant portion of the X-rays generated are waste radiation that is not utilized. Further, because the intensity or "brightness" of the beam decreases drastically as the distance from the anode increases because of beam divergence, the effective range of the beam is limited. If the target object is too close to the anode, it may be subject to more radiation than desirable, and if the target object is too far away from the anode, the object may not receive the required intensity of X-rays to facilitate the desired result. Ultimately, the drawbacks of a conventional X-ray apparatus increase the apparatus's necessary size effectively making small, light and portable equipment impossible to create.

SUMMARY OF THE INVENTION

An apparatus (or device) for generating high intensity X-rays is described. An embodiment of the apparatus comprises a source for generating a focused beam of electrons, and at least one X-ray anode in the form of the interior surface of a metallic tube.

BRIEF DESCRIPTION OF THE DRAWINGS

FIG. 7A illustrating several arrays for finely focused the X-rays; and FIG. 7B illustrating several arrays for high powered X-ray beams.

DETAILED DESCRIPTION OF EMBODIMENTS OF THE INVENTION

Introduction

Figure 1:
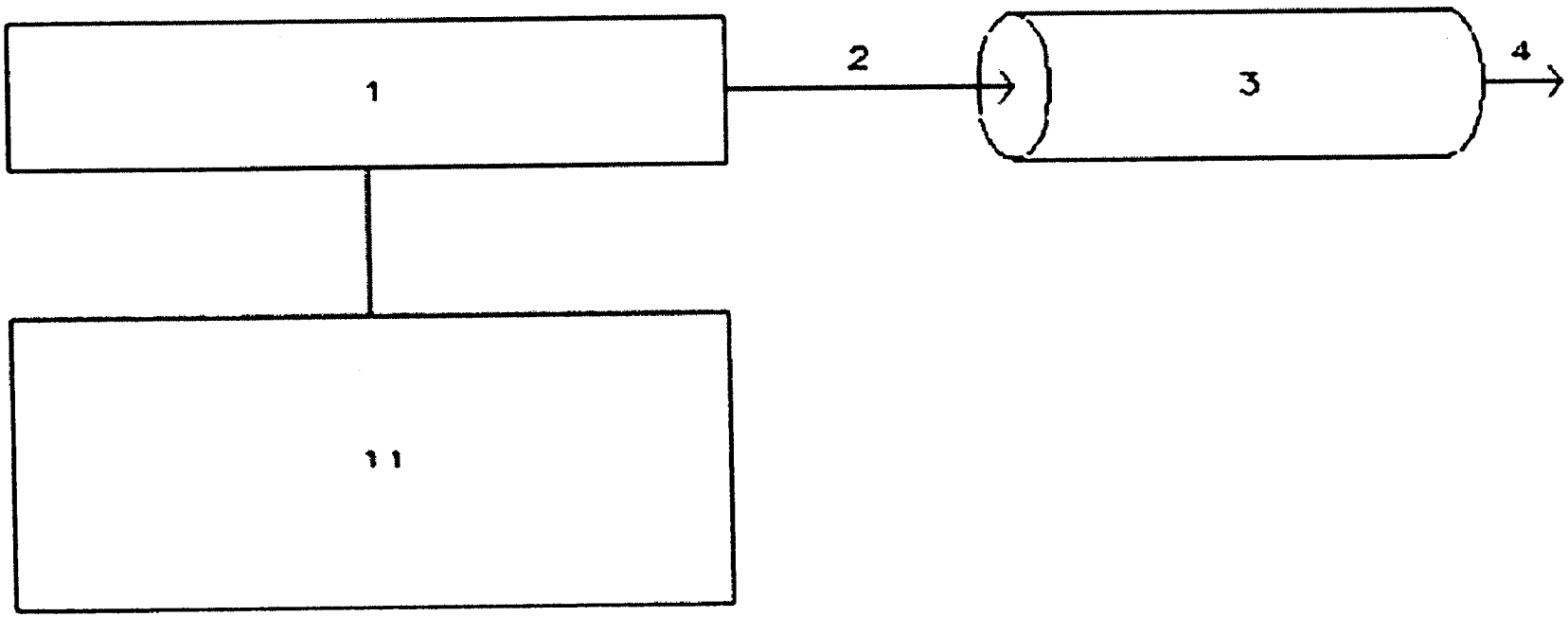
FIG. 1 is a simplified block diagram of a X-ray generation apparatus according to one embodiment of the present invention.

In the following description, numerous details are set forth. It will be apparent, however, to one skilled in the art that embodiments of the present invention may be practiced without these specific details. In other instances, well-known structures, devices, and techniques have not been shown in detail, in order to avoid obscuring the understanding of the description. The description is thus to be regarded as illustrative instead of limiting.

Reference in the specification to "one embodiment" or "an embodiment" means that a particular feature, structure, or characteristic described in connection with the embodiment is included in at least an embodiment of the invention. The appearances of the phrase "in one embodiment" in various places in the specification are not necessarily all referring to the same embodiment.

An X-ray generation device and method for producing a focused highly unidirectional beam of X-rays are described. Advantageously, the energy and shielding requirements of the device compared to conventional X-ray generation apparatus are substantially reduced facilitating the incorporation of the device in portable X-ray equipment.

Embodiments of the device comprise one or more tubular anodes, hereafter referred to as capillary tube anode assemblies, comprised of a thin metallic tube layer. Highly focused electron beam(s) are directed in one end of the capillary tube anode(s), wherein they graze the surface of the anode and create X-rays of a characteristic spectrum based on the particular metallic tube layer utilized. A focused highly directional beam(s) of X-rays exits the other end of the capillary tube anode(s).

LIST OF FIGURE REFERENCE NUMERALS

1—Source of high-energy electrons
2—Beam of high-energy electrons from (1)
3—Capillary tube anode assembly
4—Directional X-ray Beam
5—metallic tube layer
5*a*—Metallic layer at a termination end of the capillary tube anode, composed of same material as the capillary tube anode metallic layer (5)
6—Heat-conducting layer
7—Radiation absorbing layer
8—Expanding high-energy electron beam

9—Location of high-energy electron beam striking the inner surface of capillary tube anode metallic layer (5) at grazing incidence

10—Paths of radiation emitted from metallic capillary anode tube layer (5)

11—Variable high-voltage power supply

12—Deflection region

13—Paths of deflected high-energy electron beams

14 A–D—Arrays of capillary tube anodes

15—a column of capillary tube anodes

16—Radiation transparent mechanical support layer

The Generation of X-Rays

X-rays are generated whenever a beam of high-energy electrons strike a metallic anode. The collision causes the emittance a spectrum of X-rays, typically consisting of two basic components: (1) a line spectrum of radiation characteristic of the anode material struck by the high energy electrons (only whenever the voltage is over a certain threshold); and (2) a continuous spectrum which depends only on the value of the high voltage that accelerated the electrons.

Each anode material generates (and will not absorb) its own characteristic line spectrum that is distinct and different from the line spectrums of other suitable anode materials. An anode material having greater atomic masses will typically generate characteristic line spectrums at shorter wavelengths while anode materials of lesser atomic masses will typically generate characteristic line spectrums at longer wavelengths.

When X-ray radiation is emitted from within an ultra-thin metallic anode layer (also referred to as a "conversion layer"), the characteristic line spectrum is generally not broadened by scattering, making such characteristic line spectrums most unique and most suitable for spectral study and recognition.

When X-ray radiation strikes a material surface at a sufficiently small angle, it is mostly reflected. This means that if radiation begins to travel (at a sufficiently small angle to the wall) along the inside of a long thin hollow metal tube (such as the capillary tube anode assembly 3 shown in FIG. 1), the radiation will be guided down the length of the tube. If the tube comprises the same metallic anode material from which the X-ray radiation was generated, the tube cannot absorb the characteristic spectrum of that radiation, rather it can only guide the radiation down the tube. However, any continuous spectrum X-ray radiation generated from the initial collision with a metallic anode material will either be at least partially absorbed by striking the sides of the thin metal tube as the X-rays are guided down the tube or pass through the metallic tube. Accordingly, the X-rays eventually emitted from the tube will comprise in greater relative quantities wavelengths of the characteristic line spectrum when compared to X-rays generated using conventional means wherein the X-rays are not guided down a metallic tube of the same material as the anode. The thickness of the metal tube need only be very thin since only the initial dozen atomic layers or so participate in guiding the characteristic line spectrum X-rays. As shown in FIG. 2 for instance, a typical capillary tube anode assembly 3 of the embodiments of the present invention comprises not only a metallic tube layer 5 but also (1) a heat conduction layer 6 to dissipate any heat generated from the collisions of X-rays and electrons against the interior surface, and (2) a X-ray radiation absorbing layer 7 to absorb any continuous spectrum X-ray radiation that passes through the metallic tube layer, as well as, the very small amount of characteristic line spectrum radiation that collides with the metallic layer at too steep an angle and also passes through the metallic tube layer.

Figure 3:
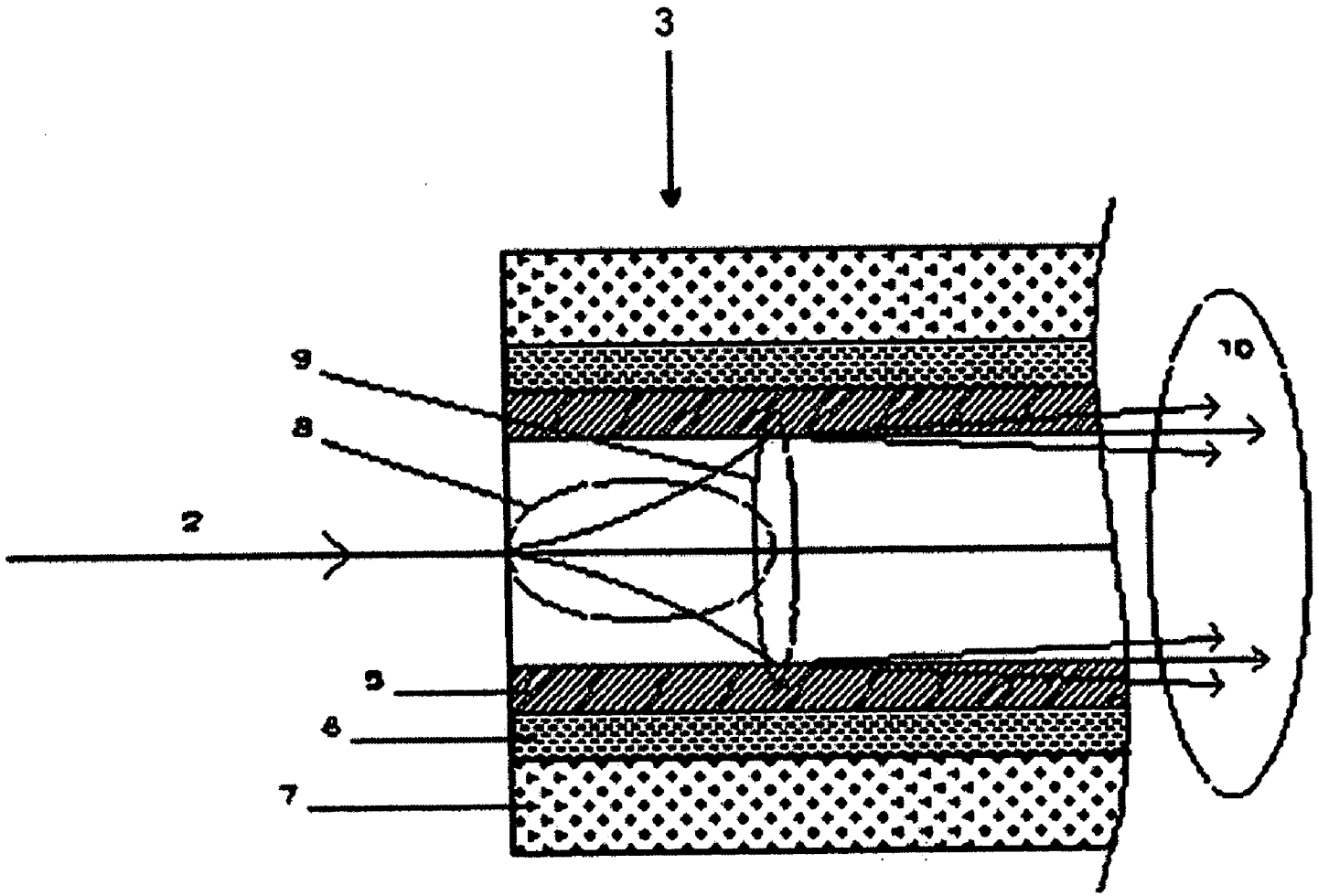
FIG. 3 is a cross sectional side view of a capillary tube anode assembly according to one embodiment of the present invention illustrating the propagation of the electron beam and the generation of X-rays therefrom.

It is to be appreciated that in addition to being utilized as an X-ray radiation guide, the capillary tube anode assembly 3, as its name suggests can also be used to generate X-ray radiation through collisions with electrons from a high-energy electron beam. Referring to FIG. 3, if a high-energy beam 2 of electrons is arranged to axially enter an electrically conductive metallic tube, such as the metallic tube layer 5 of the capillary tube anode assembly, the high-energy beam will experience a large space charge repulsion when inside the tube, causing the beam to expand until the expanding high-energy electron beam 8 grazes the inside surface of the metallic tube layer 5 at a location 9 along the inside surface of the metallic tube layer. The energy of the electrons will be partially converted to X-rays at the grazing location 9. The characteristic line spectrum radiation generated at grazing incidence is guided down the capillary tube anode substantially along its axis and exits from the metallic tube's other end as a highly collimated beam. As stated above, the directional X-rays 10 propagated by the capillary tube anode consist primarily characteristic line spectrum radiation related to the particular metallic material comprising the metallic tube layer, since the other wavelengths of the continuous spectrum radiation are substantially scattered or absorbed. This provides a useful spectral filtration function.

When X-rays are only produced in a preferred forward direction with little divergence or scattering, the brightness or intensity of the useful portion of the X-ray beam is increased for a particular energy input into the X-ray generation device, thereby increasing the energy efficiency of the device. Additionally, less shielding is required to absorb X-rays emitted in non-preferred directions since the proportion of X-rays diverging from the beam is relatively small. Because of the advantages afforded through the use of an X-ray generation device using capillary tube anodes, the device can be made to be extremely portable, battery powered, and even hand-held.

The interior surface of the metallic tube layer 5 of the capillary tube anode 3 is generally cylindrical having a circular cross section; however, in variations the interior surface can have any suitable cross sectional shape such as elliptical or hexagonal. As used herein cylindrical refers to any tube with any suitable cross sectional shape. Further, the tube layer can be frustoconical with the diameter or dimensions of the tube layer either increasing or decreasing from the end wherein the high-energy electron beam is input and the other end of the tube layer where the X-ray beam exits.

Figure 2:
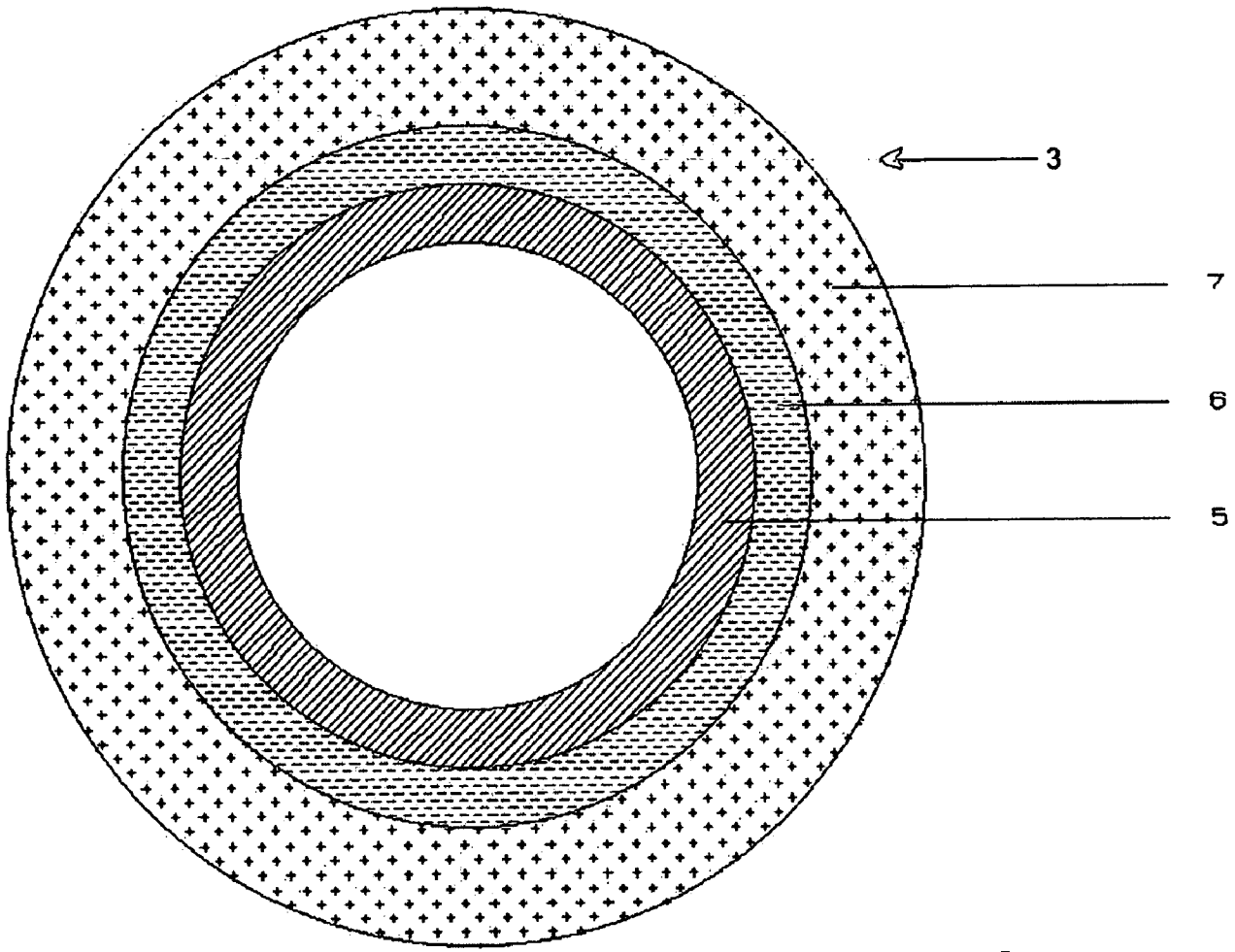
FIG. 2 is a cross sectional end view of a capillary tube anode assembly according to one embodiment of the present invention.

FIG. 1 is a block diagram illustrating the basic components of a typical X-ray generating device of one preferred embodiment of the present invention. A source 1 for generating a high-energy beam of electrons 2 is provided and is electrically coupled to a variable voltage power supply 11. Both the high-energy electron beam source generators and variable voltage power supplies are well known in the art, and suitable power supplies and electron beam sources (or generators) would be obvious to one of ordinary skill in the art with the benefit of this disclosure. The high-energy electron beam source outputs a relatively narrow high-energy beam of electrons that preferably has an average diameter less than the inside diameter of an associated capillary tube anode assembly 3, which is axially aligned with the electron beam source's beam emitter and in operation with the electron beam 2 itself. As discussed above, the electron beam enters a first end of the capillary tube anode assembly, grazes and collides with the interior surfaces of the capillary tube anode assembly to create X-rays. The capillary tube anode assembly 3 guides and focuses the X-rays down the length of the capillary tube anode assembly wherein the X-rays are emitted as a highly directional beam 4 of radiation having a generally narrow line wavelength spectrum. By selectively varying, the voltage input of the power supply, the intensity or brightness of the resulting X-ray beam can be varied.

FIG. 2 shows a cross-sectional view of a preferred embodiment of the capillary tube anode tube assembly 3. The inner metallic tube layer 5 rube is comprised of the selected anode material, such as but not limited to Tungsten or Molybdenum. The metallic tube layer is typically between 10–1000 atomic layers thick and most preferably between 10–18 atomic layers thick. It is typically surrounded over all or a portion of its length by a cylindrical layer of a heat conducting layer 6, comprised of but not limited to Copper, Silver or Gold, to conduct away excess heat created as a result of the X-ray generation process. Further, the heat-conducting layer of the capillary tube anode tube assembly is typically surrounded by a radiation-absorbing layer 7 comprising a material chosen for its radiation absorption properties, such as but not limited to Lead.

FIG. 3 illustrates a high-energy beam of electrons 2 entering a capillary tube anode assembly 3 tube assembly. The high-energy beam experiences a charge repulsion upon entering the capillary tube assembly causing it to expand towards the interior surface wall of the metallic tube layer 5. The expanding high-energy electron beam 8 grazes and collides with the interior surface wall at location 9. The collision causes X-ray radiation 10 of a characteristic line spectrum related to the particular anode metal utilized to be created. As discussed above must of the radiation is directed down the assembly with the metallic tube layer acting as a guide. A small amount of radiation that passes through the metallic tube layer is absorbed by the radiation-absorbing layer. Further, most of the continuous spectrum X-ray radiation created as a result of the collision is either absorbed by the metallic tube and heat conducting layers 5 & 6 or passes through the metallic tube and heat conducting layers and is absorbed by the radiation absorbing layer 7. As a result, the X-ray radiation beam exiting the end of the capillary tube anode assembly is highly directional and is comprised primarily of characteristic line spectrum radiation.

Figure 4:
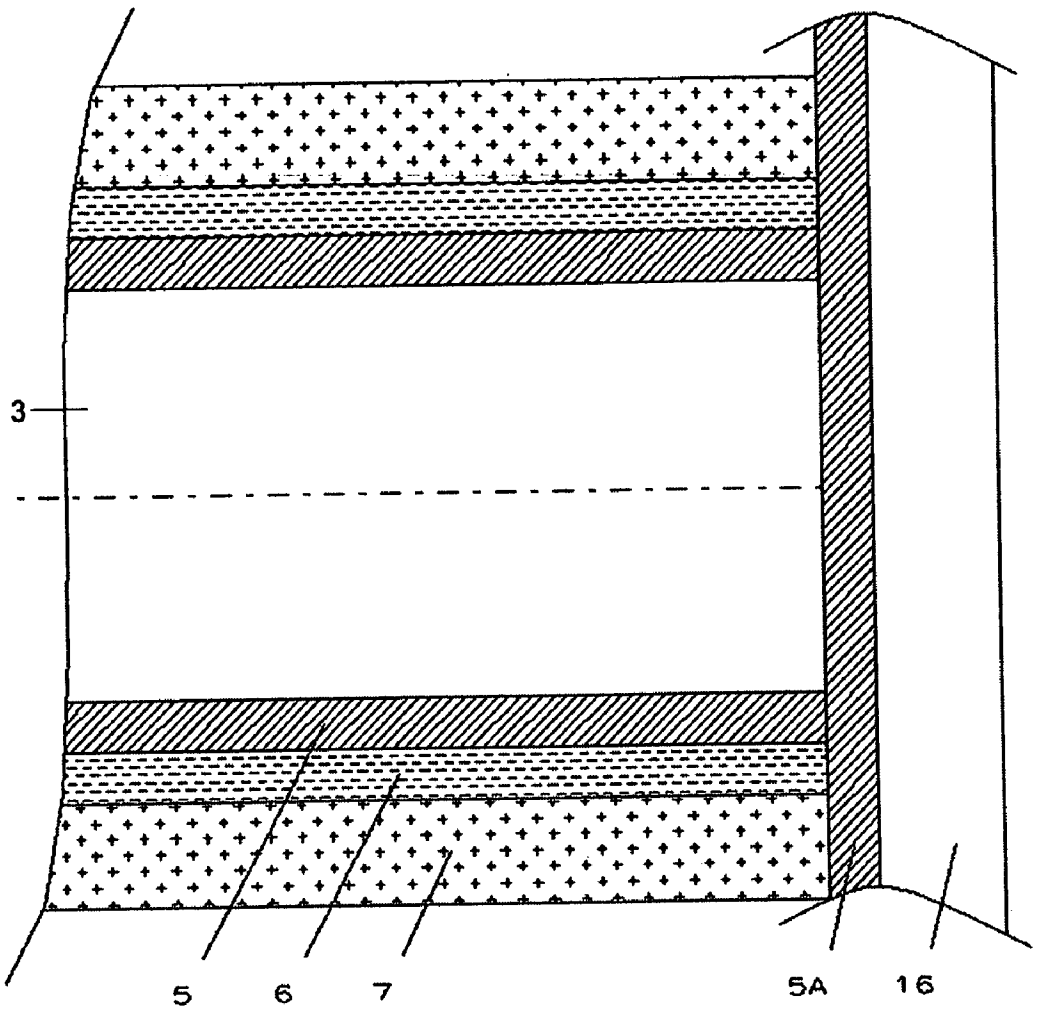
FIG. 4 is another cross sectional side view of a capillary tube anode assembly according to one embodiment of the present invention illustrating the termination of one end of the capillary tube anode assembly.

FIG. 4 shows a cross-sectional view of an embodiment of the termination of a capillary tube anode assembly 3 at the end of the assembly wherein the highly directional X-ray beam 10 exits the assembly. The termination end of the capillary tube anode assembly is typically covered first by a metallic layer 5A comprising the same material as the metallic tube layer 5 of the assembly. Accordingly, the electrons from the electron beam 2 (and 8) are provided a conductive return path and do not exit the end of the capillary tube anode assembly. The X-ray beam 10, especially radiation comprising the characteristic line spectrum passes through the metallic layer 5A to exit the tube assembly. In certain variations of the preferred embodiments of the capillary tube anode assembly, the metallic layer 5A also acts used to provide for a vacuum seal at this end of the assembly. Typically, the metallic layer 5A is very thin and accordingly, a radiation transparent support layer 16 comprised of a material such as but not limited to Beryllium may be provided for structural reasons. Further, the support layer 16 can also be used to provide a vacuum seal.

Figure 5:
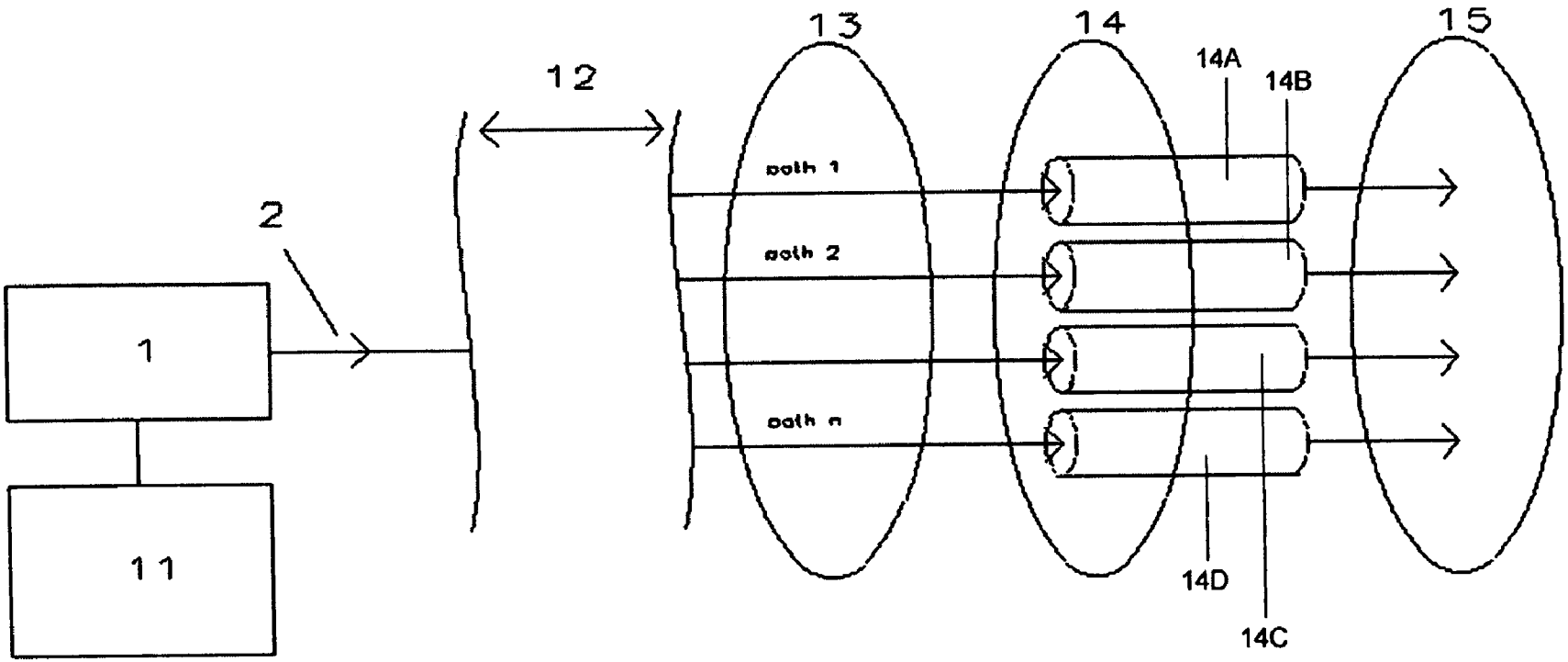
FIG. 5 is a simplified overall view of an apparatus with multiple capillary anode tube assembly arrays according to one embodiment of the present invention.

FIG. 5 shows an embodiment of the X-ray generating device of the present invention utilizing different arrays 14A, 14B, 14C & 14D of capillary tube anodes 3. The source of high energy electrons 1, such as those employed in high intensity cathode ray tubes used in projection kinescopes, emits a high energy beam 2 of electrons with a variable energy provided by the variable high voltage power supply 11. The path of the high-energy beam of electrons is deflected in region 12 by means of magnetic fields, electric fields, or a combination of magnetic and electric fields, such as those used in large high precision cathode ray tube displays. The deflection of the beam divides and redirects the beam so that the beam strikes each of the different capillary tube anodes of a particular array 14A–D. Depending on the metallic layers 5 used in each of the capillary tube anodes of the particular array, the emerging X-ray beam 4 has a characteristic line spectrum relating to the metallic tube layers 5 used in the particular array. Accordingly, a single X-ray device of the present invention with multiple arrays, wherein each array has capillary tube anodes with different metallic tube layers 5, can produce X-rays of different characteristic line spectrum depending on which array the high energy beam of electrons is deflected and directed.

Figure 6A:
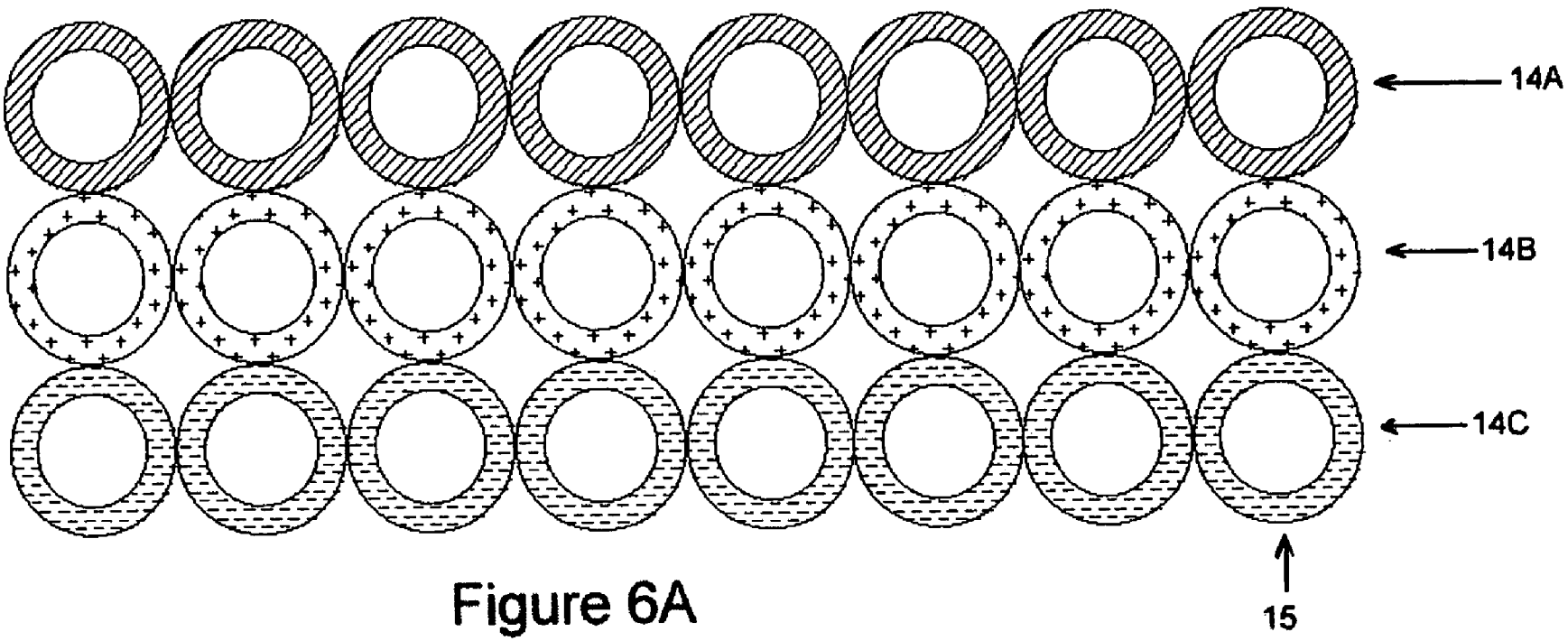
FIGS. 6A and 6B are views of capillary tube anode arrays utilizing different anode materials according to one embodiment of the present invention.
Figure 6B:
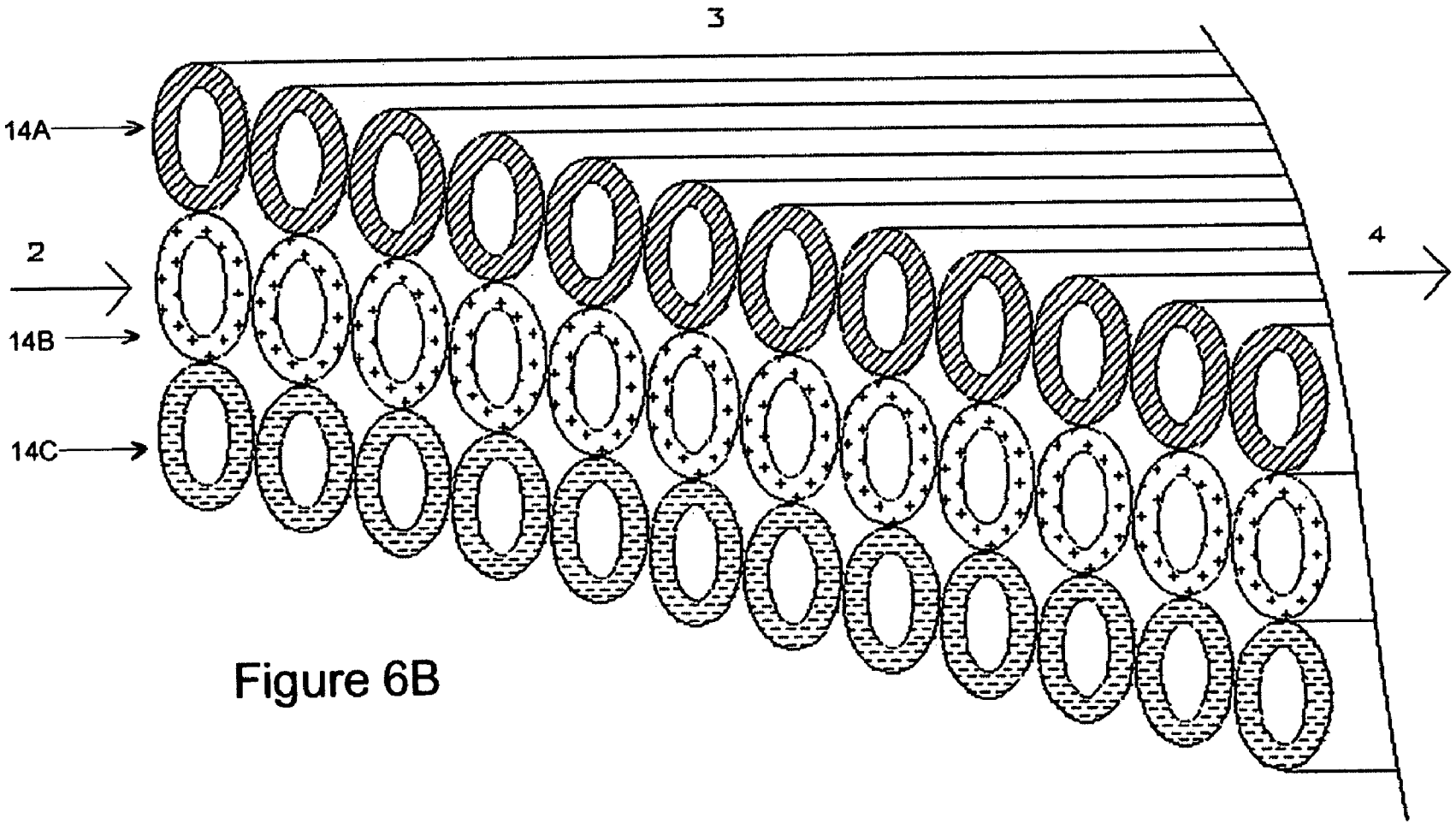

In one preferred embodiment of the device as shown in FIGS. 6*a* and 6*b*, three single row arrays of capillary tube anode assemblies are provided 14A–C. Deflection fields are applied in two transverse axes such that different arrays ("rows", for example) of capillary anodes are selected by one deflection means, and further different arrays (column 15, for example) of capillary anodes are selected by the other deflection means. In one preferred variation, the metallic tube layers 5 of a given array are all of the same material, but each of the arrays utilizes a different metallic tube layer than the other arrays. Accordingly, depending into which array the high-energy electron beam is deflected, the characteristic line spectrum of the resulting X-ray beam 4 with differ. Further, the deflection means can be applied in such a manner as to direct the beam into one or more columns of capillary tube anode assemblies such as indicated by element 15, thereby resulting in an X-ray beam having a number of different characteristic line spectrums related to each type of metallic tube layer utilized in the device. In this preferred variation, one deflection means selects the location from which radiation is emitted, the other deflection means selects among a variety of anode materials, and consequently the characteristic line spectra of radiation which is emitted, and the variable high voltage selects which of the characteristic lines within the set of all possible characteristic spectral lines will be emitted.

Figure 7A:
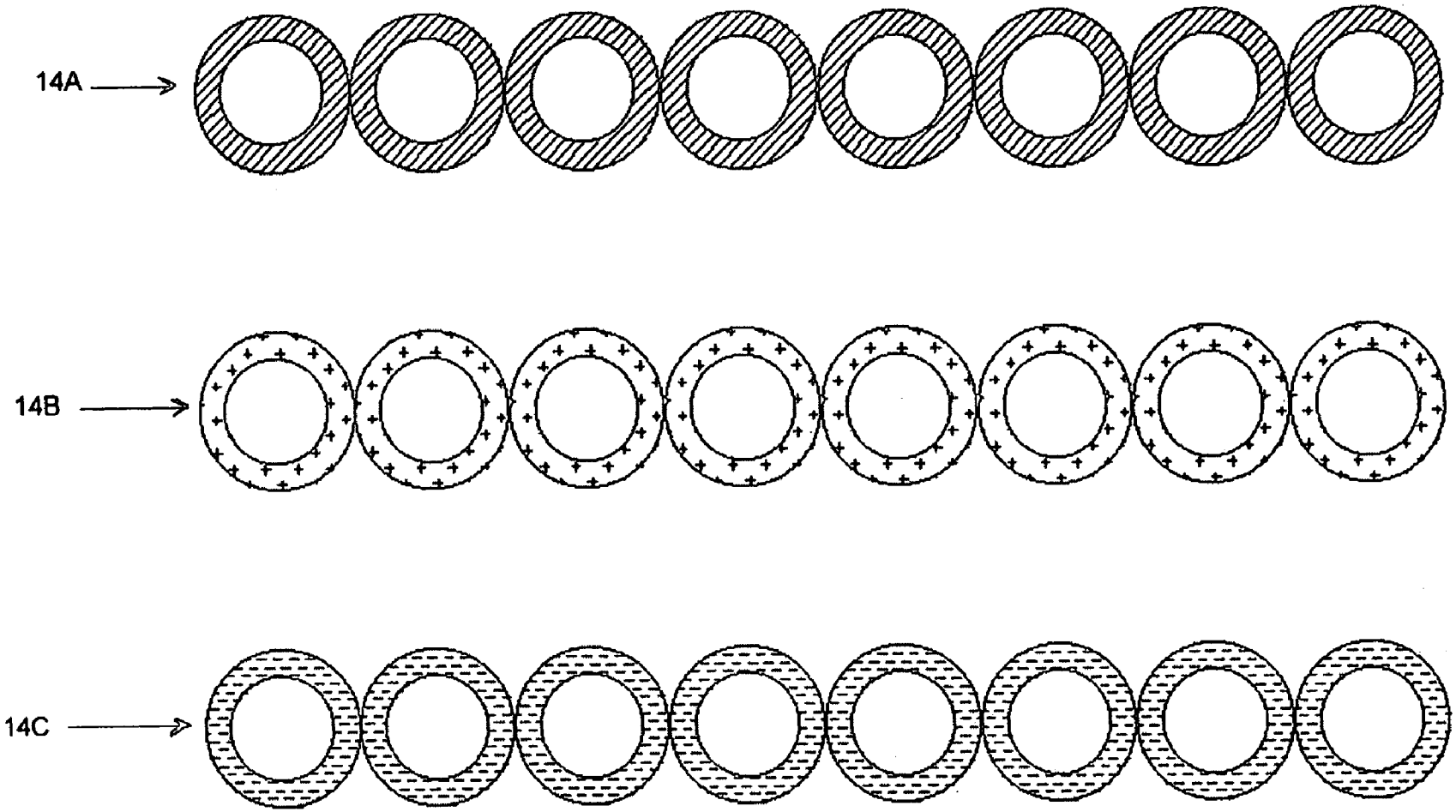
FIGS. 7A and 7B are end views of various capillary tube arrays.
Figure 7B:
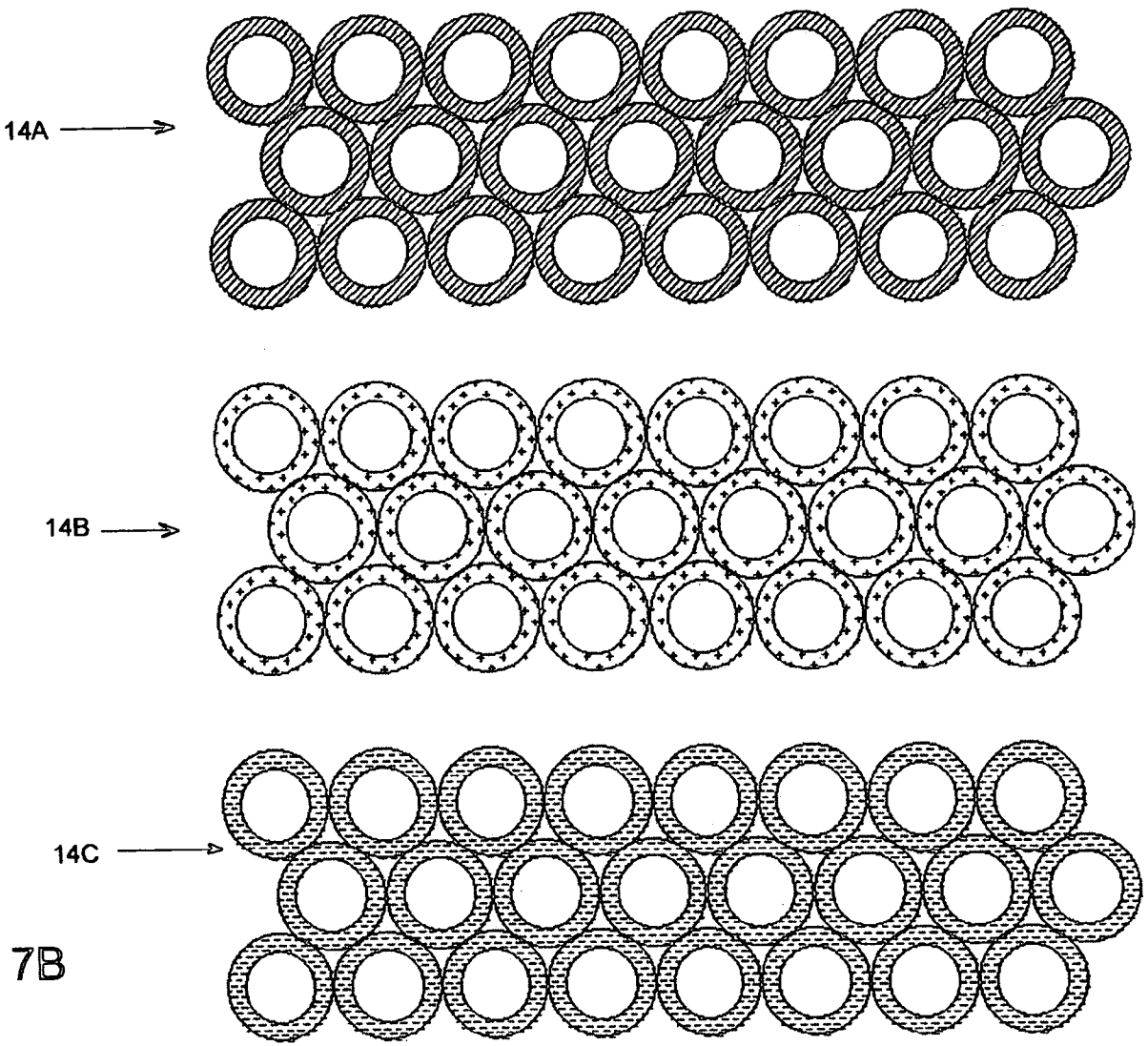

FIGS. 7*a* and 7*b* show two other variations of the preferred embodiment. The "fine focus" layout (FIG. 7*a*) utilizes a single row of capillarity tube anodes 3 per array 14A–C with each array having a different type of metallic tube layer. By scanning a selected array along its length by the high-energy electron beam 2 approximately comparable in diameter (although larger) to a capillary diameter, a very fine radiation beam diameter is possible.

FIG. 7*b* shows the "high power" layout, utilizing a packed, striped arrangement of capillary tube anode assemblies 3 for each array 14A–C (using the same metallic tube layer material in each assembly of an array). By scanning a selected array along its length by an electron beam, which can be much larger than an individual capillary anode diameter. Radiation is produced from a number of capillary tube anode assemblies simultaneously, increasing the total radiation output at the expense of the X-ray beam's diameter.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

Operation of a Preferred Embodiment of the Invention

The Source

As shown in FIG. 1, a source of high-energy electrons 1 emits a paraxial beam 2 of mono-energetic electrons of an energy controlled by the variable high voltage power supply 11.

The Deflection Region

As shown in FIG. 5, the path of the beam 2 is modified by controlled deflection fields 12 acting in two axes, such that any of a number of capillary tube anode assemblies can be selectively struck by the beam.

The X-Ray Generation Process

Referring to FIGS. 1 & 3, the high-energy electron beam 2 enters the capillary tube anode assembly 3. Once inside the assembly, each electron in the beam "sees" its reflection in the conductive wall of the metallic tube layer 5, and is attracted by it. In this way, the electrostatic image forces cause the beam 8 to expand (this is called "space charge expansion") until it hits the wall at grazing incidence angle at location 9.

Referring to FIG. 2, X-rays emitted at angles other than grazing incidence will generally penetrate the metallic tube layer 5, and the heat-conducting layer 6, and be absorbed in the radiation-absorbing layer 7. Only grazing incidence radiation survives the absorption inherent in the geometric arrangement of the metallic tube layer 5 and the axial radiation-absorbing layer 7.

The Radiation Guide Process

X-rays emitted at grazing incidence at location 9 propagate along the capillary tube anode assembly 3, causing it to function as a radiation guide. But, in order to be refracted from the inner surface of the metallic tube layer 5, the radiation must penetrate the layer very slightly.

The Spectral Filtration Process

Since every material does not absorb radiation of its own characteristic line spectrum, X-rays consisting of the characteristic line spectra of the capillary tube anode assemblies' metallic tube layer 5 are not absorbed by metallic tube layer 5, and pass through the metallic layer 5A comprising the same material as the metallic tube layer (see FIG. 4). However, the continuous spectrum radiation produced by the grazing incidence impact of the high energy electron beam 2 on the inner surface of the metallic layer will continue to be absorbed and scattered by any matter in its path. So only the characteristic line spectrum radiation will remain after sufficient path length in the capillary tube anode assembly.

The Spectral Selection Process

Referring to FIGS. 6A & B, the first axis of an orthogonal two axis deflection system allows the selection of one of an array 14A–C of capillary tube anode assemblies having the same metallic tube layer material but having an multiplicity of differing physical locations, for example, a linear array. Each of the capillary anode tubes of the same material will generate the same characteristic line spectrum, and varying the high voltage power supply 11 of FIG. 5 will affect the spectrum of all the tubes simultaneously. The second axis deflection system allows the selection of one of a collection of similar arrays of capillary tube anode assemblies, each array of which has in common some prearranged different anode material. When the physical separation between capillary anode tubes of different anode materials is minimized, the radiation will appear to be coming from a single location, e.g. from a single point in a linear array.

We claim:

1. An apparatus for generating high intensity X-rays of a characteristic line spectra comprising:

a source for generating a focused beam of electrons; and a plurality of X-ray anodes, each in the form of a capillary tube having a bore, an interior surface of the bore comprising a metallic tube layer with a thickness of 10–1000 atomic layers;

wherein the plurality of X-ray anodes include at least a first linear row of anodes and a second linear row of anodes, the metallic tube layer of each anode of the first linear row comprising a first metallic material and the metallic tubular of each anode of the second linear row comprising a second metallic material, the first metallic material being different than the second metallic material.

2. The apparatus of claim 1, further comprising an electron beam deflector adapted to selectively deflect the focused beam of electrons along one of the first and second linear rows.

3. The apparatus of claim 2, wherein the electron beam deflector is further adapted to selectively deflect the focused beam of electrons between the first and second linear rows.

4. The apparatus as in claim 1, further comprising a variable voltage power supply for powering the source.

5. The apparatus of claim 1, wherein the first material comprises one of Tungsten and Molybdenum.

6. The apparatus of claim 1, wherein a heat-conducting layer overlies the metallic tube layer of each X-ray anode of the plurality of X-ray anodes.

7. The apparatus of claim 6, wherein the heat-conducting layer comprises one of gold, silver and copper.

8. The apparatus of claim 1 wherein an X-ray radiation-absorbing layer overlies the metallic tube layer of each X-ray anode of the plurality of X-ray anodes.

9. The apparatus of claim 1, wherein an end of each metallic tube layer through which the X-rays exit is sealed by a thin layer of metallic material of essentially the same composition as the material comprising the metallic tube layer.

10. The method of claim 1, wherein each X-ray anode of the first linear row of anodes is in contact with another X-ray anode of the first linear row of anodes.

11. An apparatus for generating high intensity X-rays comprising:

a source for generating a focused beam of electrons;

at least one first X-ray anode and at least one second X-ray anode, each of the first and second X-ray anodes being in the form of an interior surface of a metallic tube, the metallic tube of the first X-ray anode comprising a first material, and the metallic tube of the second X-ray anode comprising a second material, the second material being different from the first material; and an electron beam deflector adapted to selectively deflect the focused beam of electrons to one of the first X-ray anode and the second X-ray anode;

wherein the at least one first X-ray anode comprises a plurality of first X-ray anodes and the at least one second X-ray anode comprises a plurality of second X-ray anodes; and wherein the electron beam deflector is adapted to deflect the electron beam to (i) one of the plurality of first X-ray anodes and the plurality of second X-ray anodes exclusively and (ii) at least one first X-ray anode and at least one second X-ray anode simultaneously.

12. A method of generating a highly directional beam of X-ray radiation, the method comprising:

directing a high energy electron beam from an electron beam generator into first ends of a first linear array of capillary tube anodes, each capillary tube anode of the first linear array of capillary tube anodes comprising a cylindrical metal tube having a thin wall thickness;

creating X-ray radiation as a result of grazing collisions with the interior surface of the metal tubes of the first linear array of capillary tube anodes;

directing a beam of X-ray radiation having essentially a characteristic line spectrum related to a specific metal utilized in the metal tubes of the first linear array of capillary tube anodes down the metal tubes and out of second ends of the capillary tube anodes.

13. The method of claim 12, further comprising deflecting the high-energy electron beam into a fractional portion of the plurality of capillary tube anodes.

14. The method of claim 12, further comprising directing the high energy electron beam from the electron beam generator into first ends of a second linear array of capillary tube anodes, each tubular anode of the second linear array of capillary tube anodes comprising a cylindrical metal tube having a thin wall thickness, wherein a metallic material comprising the cylindrical metal tube of each capillary tube anode of the second array is different from a metallic material comprising the cylindrical metal tube of each capillary tube anode of the first array.

15. The method of claim 14, wherein said directing a high energy electron beam from an electron beam generator into first ends of a first linear array of capillary tube anodes further comprises moving the electron beam linearly along the first ends.

16. The method of claim 12, further comprising directing the high energy electron beam between the first ends of the first array and the first ends of the second array.

* * * * *